US005695391A

United States Patent [19]

Steinwender

[11] Patent Number: 5,695,391

[45] Date of Patent: Dec. 9, 1997

[54] SUPER FINISHING MACHINE

[75] Inventor: Horst Steinwender, Wuppertal, Germany

[73] Assignee: Supfina Grieshaber GmbH & Co., Remscheid, Germany

[21] Appl. No.: 579,716

[22] Filed: Dec. 28, 1995

[51] Int. Cl.[6] ..... B24B 7/00; B24B 9/00

[52] U.S. Cl. ..... 451/168; 2/8; 2/47; 2/25

[58] Field of Search ..... 451/28, 25, 5, 451/8, 49, 168, 51, 59, 61, 62, 296, 303, 306, 307, 513, 514, 464, 470, 481, 491, 492, 504, 904, 172

[56] References Cited

U.S. PATENT DOCUMENTS

| | | | |
|---|---|---|---|
| 4,682,444 | 7/1987 | Judge et al. | 451/49 |
| 4,796,387 | 1/1989 | Johnson | 451/168 |
| 5,095,663 | 3/1992 | Judge et al. | 451/49 |
| 5,148,636 | 9/1992 | Judge et al. | 451/307 |
| 5,210,978 | 5/1993 | Phillips | 451/303 |
| 5,245,793 | 9/1993 | Schmitz | 451/49 |
| 5,251,404 | 10/1993 | Wasserbaech | 451/307 |
| 5,367,866 | 11/1994 | Phillips | 451/307 |
| 5,437,125 | 8/1995 | Barton, II | 451/49 |
| 5,490,808 | 2/1996 | Jantschek et al. | 451/59 |
| 5,529,529 | 6/1996 | Judge et al. | 451/51 |
| 5,531,631 | 7/1996 | Judge | 451/49 |

FOREIGN PATENT DOCUMENTS

| | | |
|---|---|---|
| 2 356 479 | 1/1978 | France . |

*Primary Examiner*—James G. Smith
*Assistant Examiner*—Derris H. Banks
*Attorney, Agent, or Firm*—Jones, Tullar & Cooper, P.C.

[57] ABSTRACT

In a microfinishing machine for machining cylindrical inner or outer faces of a work piece, a grinding belt is pressed against it with a flexible machining shell. This has the advantage that the shell can move radially in sections and as a result, the grinding belt can press in the shape of a circle against the work piece.

42 Claims, 4 Drawing Sheets

SUPER FINISHING MACHINE

BACKGROUND OF THE INVENTION

The present invention relates to a microfinishing machine for machining cylindrical inner or outer faces of a work piece, with at least one finishing element, which rests against the inner or outer face of the work piece, with clamping means for pressing the finishing element against the surface to be machined, and with means for producing a relative motion between the work piece and the finishing element, wherein the finishing element has at least one C-shaped shell which partially encompasses the surface to be machined.

There are a multitude of known microfinishing machines of this kind, which are also called honing machines or superfinishing machines. These machines are used for machining the surfaces of crankshaft bearings, crank pins, or the surface's of camshaft bearings, for example. Machines of this kind are used on the one hand for achieving the surface quality of the bearings and on the other hand the desired roundness. In microfinishing, either a finishing stone is pressed directly against the surface of the work piece to be machined or a shell is pressed against it with the interposition of a grinder belt and the work piece as a rule is set into rotation. At the same time, the work piece can carry out an axial oscillation motion so that so-called cross-grinding is produced. The oscillation motion, however, can also be carried out by the tool.

In a known process, a textile cutting belt with a relatively soft shell, which is comprised, for example of Vulcolan, is pressed against the shaft surface to be machined. With this soft shell, it is in fact possible to press the textile grinding belt over a large area against the surface to be machined, wherein the changing of the shaft diameter during the machining process is of virtually no significance. It has proven to be disadvantageous, though, that when aqueous lubrication emulsions are used, the textile grinding belt absorbs them completely and as a result, swells. Furthermore, with soft shells, no or only slight shape corrections to the shaft are possible, since wariness is not completely ground down.

In contrast, when there are wavy surfaces, shape corrections can be achieved with hard shells which rest against the tips of the waves and wear them down. Thus the shape of the shell can be transferred to the shaft. In this case, though, an incompressible belt is required (see European Patent Publication EP-A-161 748).

With this kind of shell, it has turned out to be disadvantageous that only with a very defined diameter do they optimally press the grinding belt against the shaft surface. If the shaft diameter is greater, even if only slightly, then the hard shell essentially presses the grinding belt against the shaft surface over two line-shaped regions, wherein the line-shaped regions, viewed in the circumferential direction, are essentially at the ends of the shell. When there is a smaller diameter, the hard shell presses the grinding belt against the shaft only in a small central region. Therefore when the diameter of the shaft does not exactly correspond to the diameter of the recess of the shoe, it is guaranteed that the grinding belt is not pressed in its entirety against the shaft. Furthermore, it has turned out that with shafts which are too large in diameter, which is always the case with shafts which have been ground but have not yet been microfinished, the front and rear edges of the hard shoe cause a rippling of the cylinder surface. A shape correction is also hardly possible in this case.

If the shaft is machined not with a grinding belt, but with a finishing stone, then the above-mentioned problem of shape correction does not arise, since the stone fits the radius of the shaft as a result of permanent abrasion, which is not the case when a grinding belt is used.

SUMMARY OF THE INVENTION

Based on a flexible shell, which can in fact adapt itself to a changing diameter, but which causes no shape correction, on object of the present invention is to produce a microfinishing machine which can achieve an optimal work result when superfinishing.

This object is attained according to the present invention in that the shell is flexible in such a way that it can radially adapt in a circular geometrical manner to the surface to be machined.

The flexible embodiment of the shell now produces the possibility that when the diameter of the work piece changes, the shell can be radially guided so that it can always rest against the work piece in a circular geometrical manner over its entire length. As a result of this, the advantage is attained that the local pressure remains constant and that the grinding belt is optimally utilized. In this manner, during machining the shell adapts itself permanently to the changing diameter of the work piece surface to be machined. Thus the tips of waves can be worn down and the shape correction can be achieved. Shells of this kind are therefore adaptive.

In an improvement, it is provided that the surface of the shell oriented toward the work piece to be machined is provided with at least one recess, open at the edge, for example a slit, and extends parallel to the axis of rotation. In this manner, the shell, which as a rule is made of a rigid, inelastic material, maintains a certain flexibility or elasticity. The slits extend radially to the work piece or in the shape of rays so that the shell can be slightly deformed orthogonal to the rays and the diameter of belt contact can be changed as a result. In this manner, the curvature of the shell can be adapted to various machining diameters. The change is in the range of a few μm.

In another embodiment, it is provided that the surface of the shell oriented away from the work piece to be machined is provided with at least one recess open at the edge, for example a slit, and runs parallel to the axis of rotation. Another embodiment provides that both surfaces are provided with slits. In this manner, a high flexibility of the shell is maintained when the material is very hard and brittle, for example with stone or ceramic. The slits can be disposed offset at intervals. The shell has a cross sectional form shaped like lamellas, wherein the tips of the lamellas rest against the work piece.

The slits can have an arbitrary cross section, but advantageously have an essentially rectangular cross section.

The elasticity of the shell is determined by the depth of the slits, wherein the depth of the slits is advantageously the same or greater than half the thickness of the adaptive shell. In an exemplary embodiment, the slit depth corresponds to approximately 80% of the thickness of the shell. The width and the spacing of the slits can be selected so that the shell still has a sufficient contact region. According to necessity, the slit width can be 5% to 40%, in particular 25%, of the contact region. The shell preferably is a pressing element for a grinding belt coated with abrasive. A shell of this kind guarantees that the grinding belt rests against the surface to be machined with the same local pressure over the entire length of the shell, wherein this is independent of the actual diameter of the work piece.

Since during machining of the work piece, the thickness or size of the belt is changed due to the influence of a cooling/lubricating agent and likewise of wear, the shell is a pressing element for an abrasive-coated, in particular thin, grinding belt. This fact is nevertheless taken into account by the adaptive shell. Furthermore, the change in thickness of the belt can be limited by the fact that thin-coated belts or films are used. Belts of this kind, which have a thickness of for example 200 μm when unused, have a thickness of approximately 100 μm when worn.

In another exemplary embodiment the shell is coated with an abrasive on its surface which rests against the work piece, in particular with CBN (cubical boron nitride), diamonds, etc. In this exemplary embodiment, the shell itself is used as an abrading tool, by means of which a higher shape precision is achieved.

In another embodiment, the shell contains bonded abrasive, e.g. special fused alumina or SiCa and is embodied after the fashion of a grinding stone.

According to a preferred exemplary embodiment, the shell is an expansion chuck shoe. The shoe has a hollow space for a pressure medium, which space extends parallel or coaxial to the contact face. The wall between the hollow space and the contact face is embodied to be flexible, so that during the machining process it can follow each diameter change, but wears away only the tips of waves on the surface at the beginning of machining.

According to a preferred exemplary embodiment, the expansion chuck shoe is made of a flexible, fluid-tight material, for example steel, rubber, plastic, or the like.

The expansion chuck shoe can be used as a support for the pressing element, which is embodied to be lamella-like. In this manner the pressing element is supported completely and each lamella is optimally guided in the radial direction. In another embodiment, the lamella-like pressing element can also be supported at points.

The present invention also relates to an adaptive finishing element for a microfinishing machine, wherein the element has one or a plurality of the above features.

The shell can be made of a single part or of multiple parts or two shells can be combined with each other.

Other advantageous features, advantages, and details of the present invention ensue from the following description, in which several exemplary embodiments are represented in detail, making reference to the drawings. The features shown in the drawings and mentioned in the claims and in the specification Can be essential to the present invention each singly or in an arbitrary combination. Combinations of disclosed features which are neither shown nor described are also intended to be included.

DETAILED DESCRIPTION OF THE PREFERRED EMBODIMENTS

Figure 1:
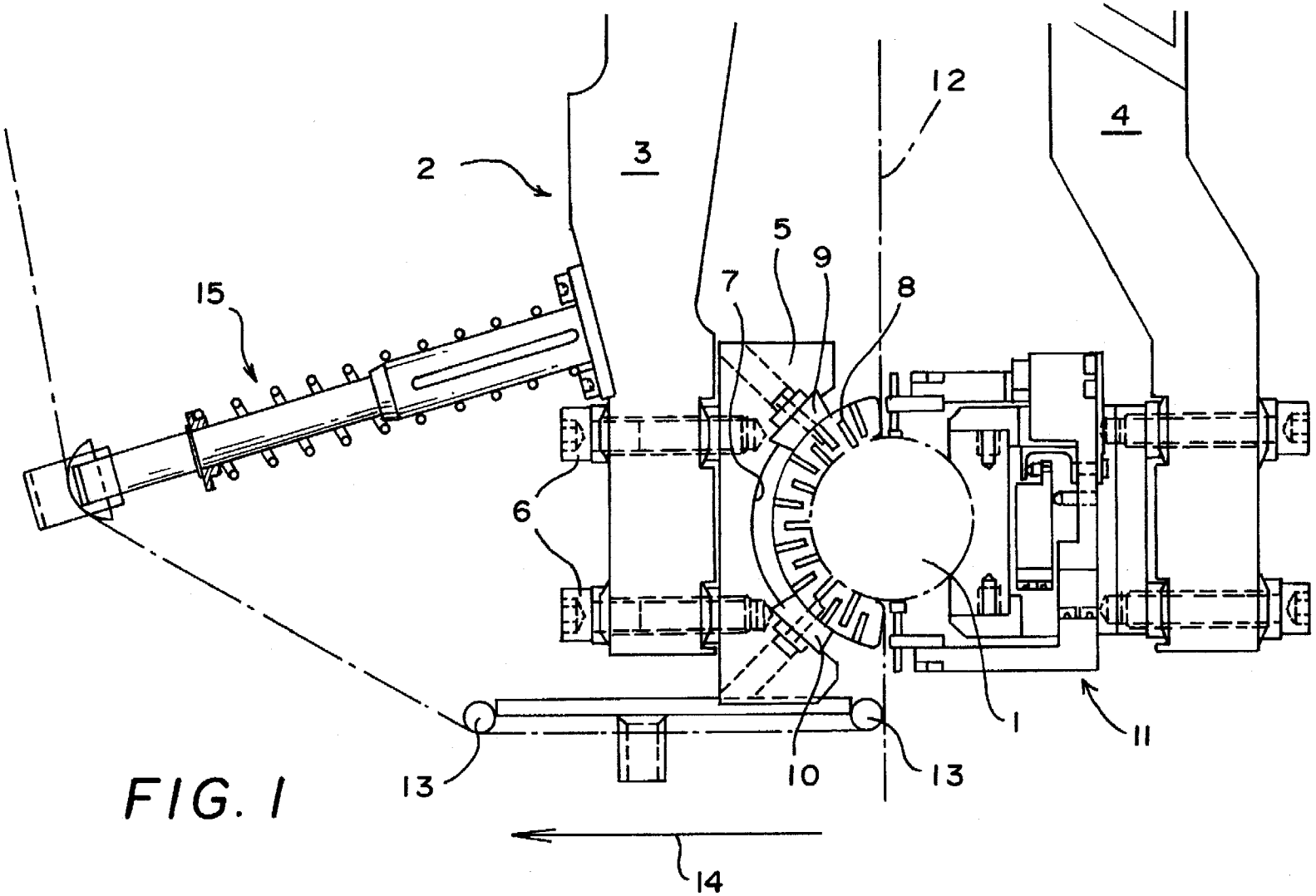
FIG. 1 is a schematic diagram of a flexible machining shell in a belt finishing machine.

FIG. 1 shows a schematic representation of the end of a pair of machining tongs 2 oriented toward a work piece 1, for example a crankshaft bearing, wherein the two arms 3 and 4 of the tongs 2 are shown in their closed position in FIG. 1. On its free end, the machining arm 3 has a shoe 5 which is connected to the machining arm 3 via two fastening screws 6. The shoe 5 is screwed to the side of the arm 3 oriented toward the work piece 1. On its side oriented toward the work piece 1, the machining shoe 5 is provided with a recess 7 essentially in the shape of a graduated circle, in which a flexible machining shell 8 is received via two fastening elements 9 and 10. The other machining arm 4, on its side oriented toward the work piece 1, carries a measurement device, identified by 11 as a whole and is not shown in detail, with which in-process measurements can be carried out. For example, the diameter of the work piece 1 and surface waves can be measured with this measurement device 11 during machining.

The abrasion of material from the work piece 1 is carried out via a grinding belt 12, which is guided between the two machining arms 3 and 4 of the flexible machining shell 8 and is pressed against the surface of the work piece 1 by the flexible machining shell 8. Along the entire length of the machining shell 8, i.e. over the entire circumference angle covered by the machining shell 8, the grinding belt 12 rests against the work piece 1 and is continuously or incrementally abraded in the lower region. The grinding belt 12 is deflected by two deflection rollers 13 and is conveyed in the direction of the arrow 14. A stretching device, identified by 15 as a whole, stretches the grinding belt 12 out and exerts a tensile strain on it. As a rule, the abrasion is 5 μm to 8 μm, but with in-process measurement, can also amount to 30 μm. Circularity errors of from 2 μm to 5 μm are corrected, i.e. ground down.

Figure 2:
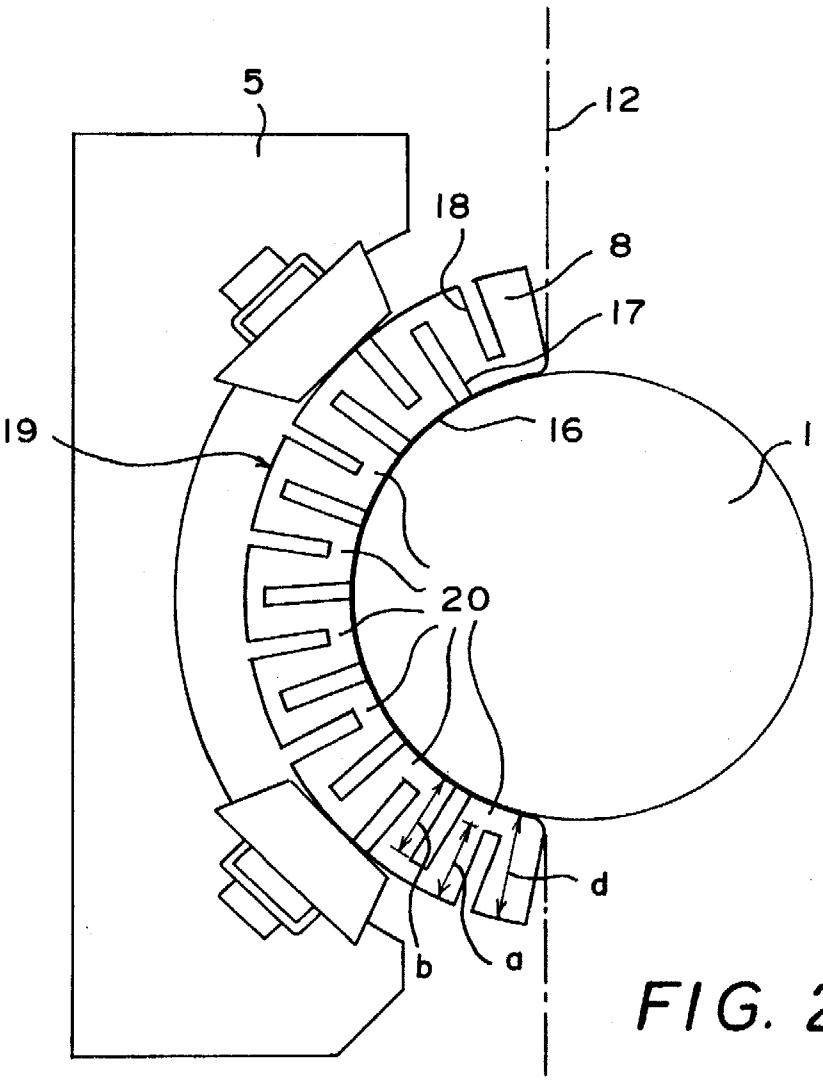
FIG. 2 is an enlarged representation of the machining shell of FIG. 1.

FIG. 2 shows an enlarged representation of the flexible machining shell 8 resting against the work piece 1. It can be clearly seen that the shell 8 presses the grinding belt 12 against the surface of the work piece 1 over its entire length. The machining shell 8 supports the grinding belt 12 with its first surface 16, which is oriented toward the work piece 1. The machining shell 8 retains flexibility because of the slits 17 and 18, which are open at the edge, wherein the slits 17 are open toward the first surface 16 and the slits 18 are open toward the second surface 19 on the opposite side. The slits 17 and 18 extend radially over approximately 80% of the overall thickness d of the machining shell 8. The depth a of the slits 18 which open to the outside can be the same as the depth b of the slits 17; the two groups of slits 17 and 18, though, can also have different depths a and b. The slits 17 and 18 are disposed offset from each other, so that the machining shell 8 has an essentially meander-shaped form or a lamella shape. The machining shell 8 is relatively stiff in the direction of thickness d, that is in the radial direction to the work piece 1, so that the grinding belt 12 can be closely pressed against the surface of the work piece 1. However, in the radial direction the slits 17 and 18 impart to the individual shell sections 20 of the machining shell 8 a high flexibility or elasticity to one another, wherein the shell sections 20 per se are stiff in the radial direction. The shell sections 20 form individual U-shaped section bodies, whose adjoining free legs are connected to one another.

Figure 2A:
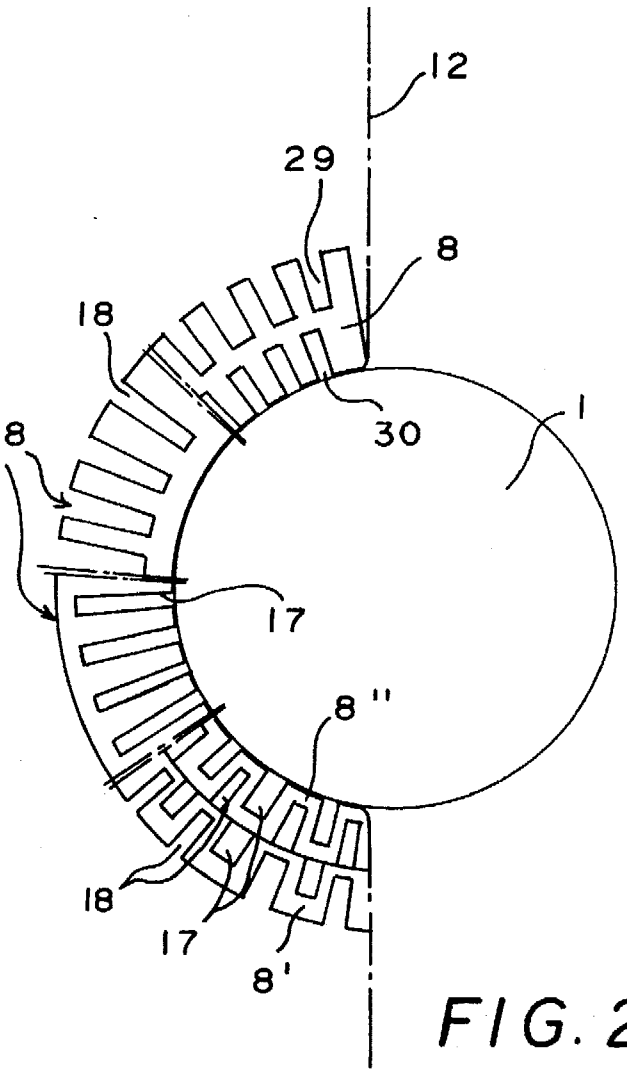
FIG. 2*a* is another embodiment of the machining shell.

FIG. 2*a* shows four preferred embodiments of adaptive shells 8. Slits 29 and 30 extend from the interior or the exterior surface of the shell approximately to the center of the shell. In this exemplary embodiment, the slits 29 and 30 are disposed offset from one another, however they can also be disposed opposite one another. In the second exemplary embodiment, only slits 18 which lead from the outer surface of the shell 8 are provided and in the third exemplary embodiment, slits 17 are provided which lead from the inner surface of the shell 8. The shell 8 indicated as the fourth exemplary embodiment is made up of two shell elements 8' and 8", which rest coaxially against each other. Corresponding slits 18 or 17 are disposed over one another radially. The embodiments shown should be understood to be exemplary and not limiting.

Figure 3:
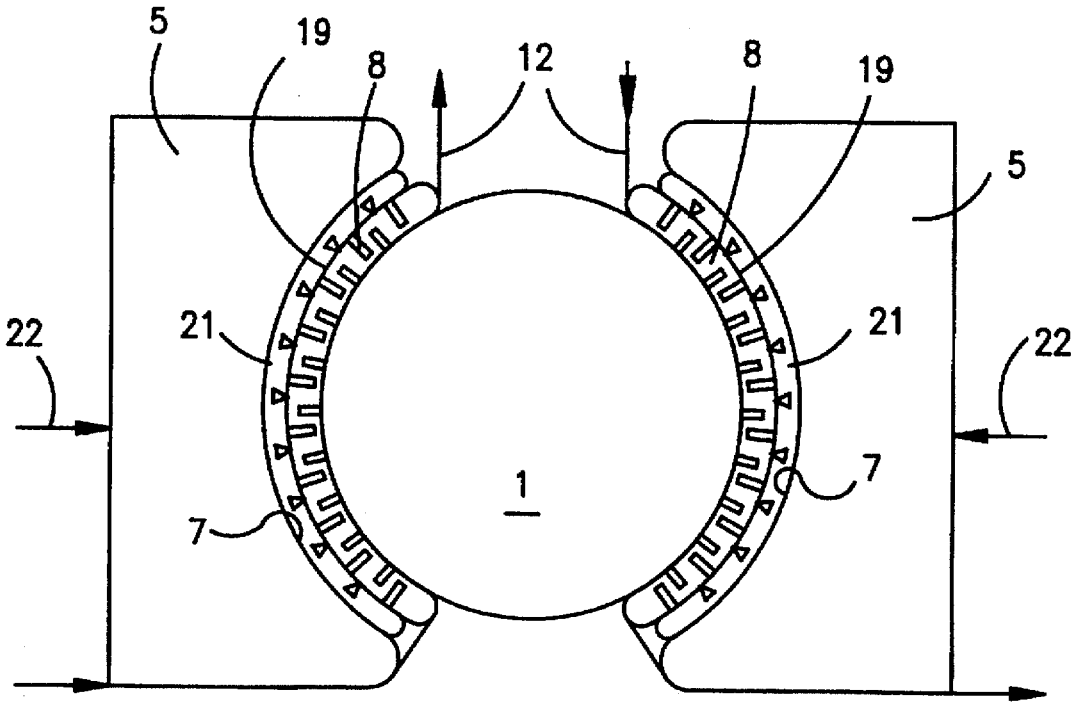
FIG. 3 is a schematic representation of another embodiment of the present invention.

The exemplary embodiment of FIG. 3 shows two flexible machining shells 8 disposed opposite each other, which are not supported at points, as in the exemplary embodiment of FIG. 1, but are supported over virtually their entire second surface 19 via a support element 21. This support element 21 is placed in the recess 7 of the shoe 5 and transmits the pressing force evenly in the direction of the arrows 22 onto the flexible machining shell 8. The support element 21 can be comprised, for example, of steel, plastic, rubber, felt, wood, or the like. In any case, it is guaranteed that the pressure is evenly transmitted. In this exemplary embodiment shown in FIG. 3, either two grinding belts 12 are used or the same grinding belt is deflected after the first run through and is fed back to the work piece 1 once again.

Figure 4:
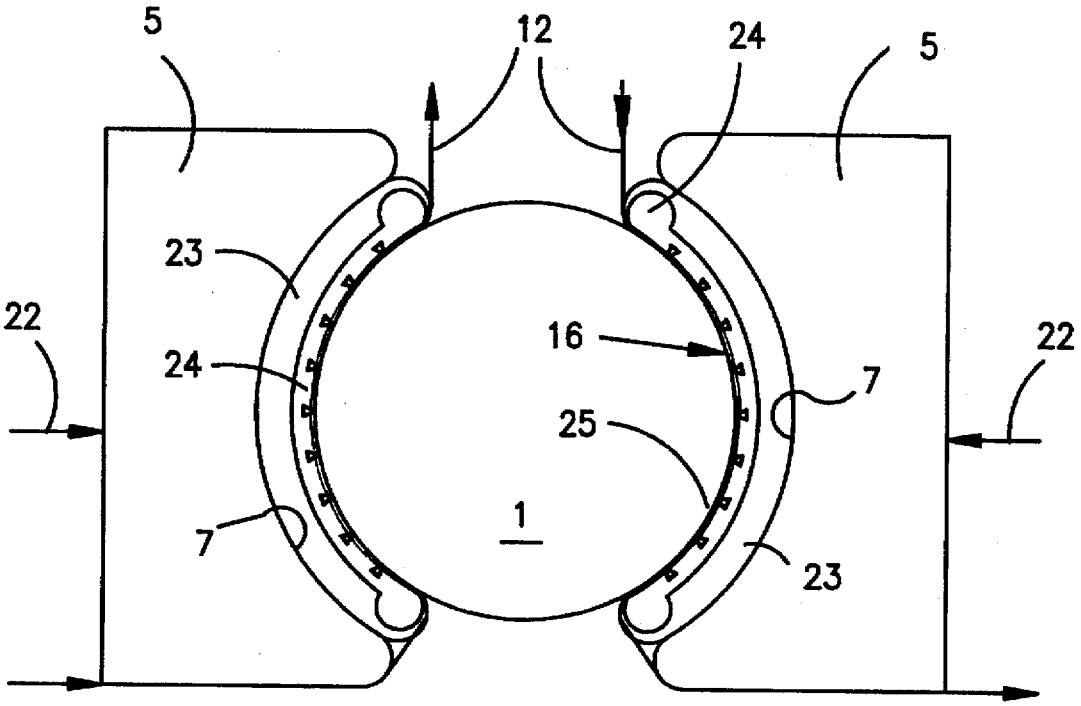
FIG. 4 is a schematic representation of a further embodiment of the present invention.

In the exemplary embodiment of FIG. 4, the flexible machining shell 8 is constituted by an expansion chuck shoe 23 which is disposed in the recess 7 of the shoe 5. This expansion chuck shoe 23 is provided with a hollow space 24, which extends over the entire length of the expansion chuck shoe 23 and is disposed directly behind the first surface 16. A relatively thin wall 25 rests against the work piece 1. The hollow space 24 is filled with a pressure medium and sealingly closed. If both shoes 5 are pressed against the work piece 1 in the direction of the arrows 22, then the pressure is evenly distributed over the entire face of the wall 25. The pressure medium is hydraulic oil or scavenging medium, for example.

In the exemplary embodiment of FIG. 4 the grinding belt 12 rests directly against the wall 25 of the expansion chuck shoe 23. In a modification, a flexible machining shell is disposed on the expansion chuck shoe. This achieves the advantage that each individual shell section 20 is pressed against the grinding belt with the same pressure.

Figure 5:
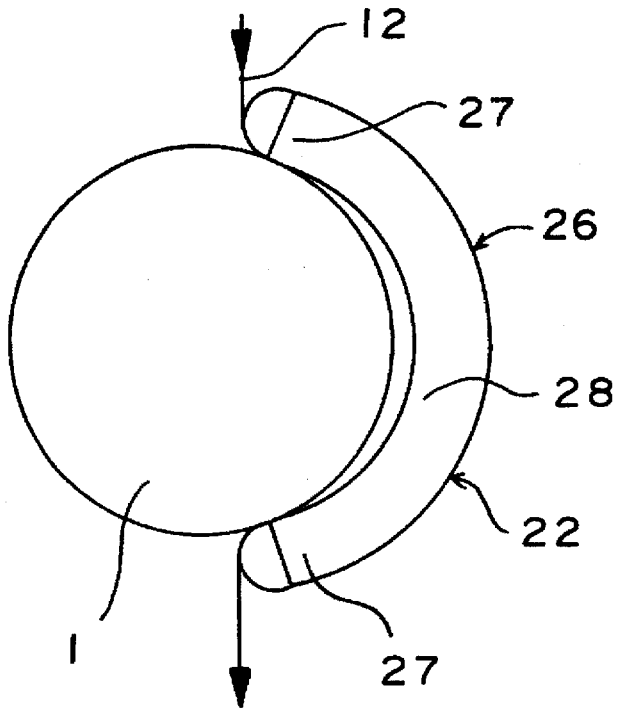
FIGS. 5 and 6 show a rigid machining shell according to the prior art.
Figure 6:
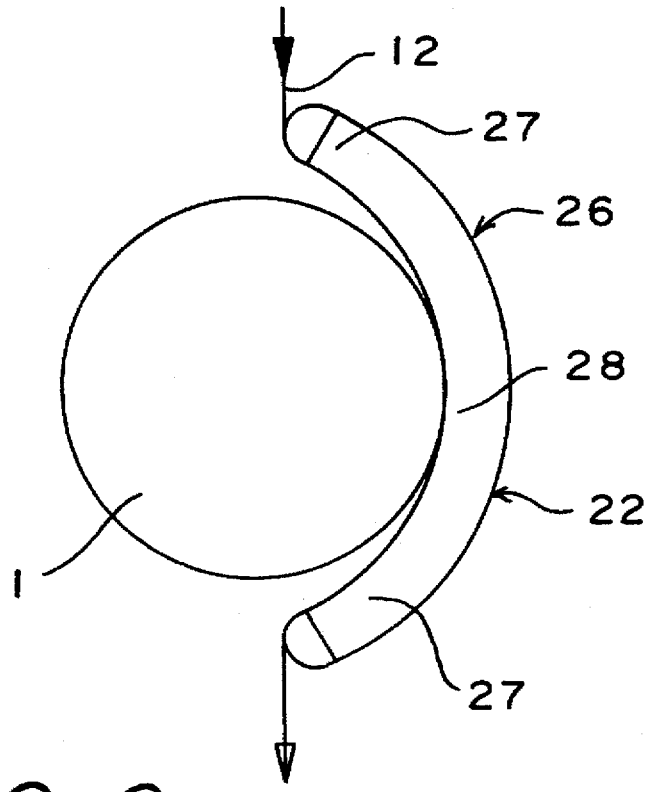

FIGS. 5 and 6 show conventional, hard shells 26. In an exaggerated manner, FIG. 5 shows the position of the shoe 26 at the beginning of the machining process. Mainly the free ends 27 of the hard shell 26 press the grinding belt 12 against the surface of the work piece 1, whereas the central region 28 hardly undergoes any abrasion of material. It can be easily seen that the hard shell 26 results in a wariness of the work piece 1, since it only rests against the work piece surface by means of the free ends 27. A shape correction at this stage of the machining cannot be achieved or can only be achieved to a small degree.

At the end of the machining process when the diameter of the work piece 1 has been reduced, the central region 28 mainly rests against the grinding belt 12 and presses it with high force against the work piece 1, while the free ends 27 only slightly press the grinding belt 12 against the work piece 1. A shape correction can in fact be achieved with hard shells 26 of this kind, but it is not as effective as with the flexible machining shell 8 according to the present invention.

I claim:

1. A microfinishing machine for machining cylindrical inner or outer faces of a work piece defining an axis of rotation, comprising:

at least one finishing element which rests against the inner or outer surface of the work piece;

clamping means for pressing said at least one finishing element against the surface to be machined; and means for producing relative motion between the work piece and said finishing element, said at least one finishing element having at least one C-shaped shell which partially encompasses the surface of the work piece to be machined, said shell being flexible in such a way that it can radially adapt in a circular geometric manner to the surface of the work piece to be machined, and having at least one recess in its surface oriented toward the work piece, said at least one recess being open at its edge and extending parallel to the axis of rotation of the work piece.

2. The microfinishing machine according to claim 1, wherein each said recess is a slit.

3. The microfinishing machine according to claim 1, wherein said recesses are disposed offset from one another at intervals.

4. The microfinishing machine according to claim 1, wherein said recesses have an essentially trapezoidal cross section.

5. The microfinishing machine according to claim 1, wherein the depth of the recesses is at least 10% of the thickness of said shell.

6. The microfinishing machine according to claim 1, wherein said shell is a pressing element for a grinding belt which is coated with an abrasive.

7. The microfinishing machine according to claim 6, wherein said grinding belt is thin.

8. The microfinishing machine according to claim 1, wherein on its surface which rests against the work piece, said shell is coated or equipped with abrasive.

9. The microfinishing machine according to claim 8, wherein the abrasive is special fused alumina, SiCa, CBN, diamond.

10. The microfinishing machine according to claim 1, wherein said shell contains bonded abrasive.

11. The microfinishing machine according to claim 10, wherein said shell is a grinding stone.

12. The microfinishing machine according to claim 1, wherein said shell is made of at least one of metal, such as steel or a nonferrous heavy metal, or of plastic, ceramic, rubber, wood, or the like.

13. The microfinishing machine according to claim 1, wherein on its back side, said shell is supported completely or at points.

14. The microfinishing machine according to claim 1, wherein said recesses are disposed opposite to one another.

15. The microfinishing machine according to claim 1, wherein said recesses have an essentially rounded out cross section.

16. The microfinishing machine according to claim 1, wherein said recesses have an essentially rectangular cross section.

17. A microfinishing machine for machining cylindrical inner or outer faces of a work piece defining an axis of rotation, comprising:

at least one finishing element which rests against the inner or outer surface of the work piece;

clamping means for pressing said at least one finishing element against the surface to be machined; and means for producing relative motion between the work piece and said finishing element, said at least one finishing element having at least one C-shaped shell which partially encompasses the surface of the work piece to be machined, said shell being flexible in such a way that it can radially adapt in a circular geometric manner to the surface of the work piece having at least one recess in its surface of oriented away from the work piece, said at least one recess being open at its edge and extending parallel to the axis of rotation of the work piece.

18. An adaptive finishing element for a microfinishing machine according to claim 17.

19. The adaptive finishing element according to claim 18, used together with at least one of a thin or incompressible grinding belt.

20. The adaptive finishing element according to claim 19, wherein said belt is comprised of plastic.

21. The adaptive finishing element according to claim 18, wherein it is used as a finishing stone.

22. The adaptive finishing element according to claim 18 wherein said shell is made of a single part.

23. The adaptive finishing element according to claim 22, wherein said shell is made of multiple parts.

24. The adaptive finishing element according to claim 18, used together with a thin and incompressible grinding belt.

25. The adaptive finishing element according to claim 24, wherein said belt is comprised of plastic.

26. The microfinishing machine according to claim 17, wherein said shell has at least one further recess in its surface oriented toward the work piece, said at least one further recess being open at its edge and extending parallel to the axis of rotation of the work piece.

27. The microfinishing machine according to claim 17, wherein each said recess is a slit.

28. The microfinishing machine according to claim 17, wherein said recesses are disposed offset from one another at intervals.

29. The microfinishing machine according to claim 17, wherein said recesses are disposed opposite to one another.

30. The microfinishing machine according to claim 17, wherein said recesses have an essentially trapezoidal cross section.

31. The microfinishing machine according to claim 17, wherein said recesses have an essentially rounded out cross section.

32. The microfinishing machine according to claim 17, wherein said recesses have an essentially rectangular cross section.

33. The microfinishing machine according to claim 17, wherein the depth of the recesses is at least 10% of the thickness of said shell.

34. The microfinishing machine according to claim 17, wherein said shell is a pressing element for a grinding belt which is coated with an abrasive.

35. The microfinishing machine according to claim 34, wherein said grinding belt is thin.

36. The microfinishing machine according to claim 21, wherein on its surface which rests against the work piece, said shell is coated or equipped with abrasive.

37. The microfinishing machine according to claim 36, wherein the abrasive is special fused alumina, SiCa, CBN, diamond.

38. The microfinishing machine according to claim 17, wherein said shell contains bonded abrasive.

39. The microfinishing machine according to claim 38, wherein said shell is a grinding stone.

40. A microfinishing machine for machining cylindrical inner or outer faces of a work piece defining an axis of rotation, comprising:

at least one finishing element which rests against the inner or outer surface of the work piece;

clamping means for pressing said at least one finishing element against the surface to be machined; and means for producing relative motion between the work piece and said finishing element, said at least one finishing element having at least one C-shaped shell which partially encompasses the surface of the work piece to be machined, said shell being flexible in such a way that it can radially adapt in a circular geometric manner to the surface of the work piece to be machined, said at least one shell comprising an expansion chuck shoe.

41. The microfinishing machine according to claim 40, wherein said expansion chuck shoe is provided with a hollow space for a pressure medium, said space extending parallel or coaxial to the contact face.

42. The microfinishing machine according to claim 40 wherein said expansion chuck shoe is made of a flexible, fluid-tight material.

* * * * *